US006685616B2

(12) United States Patent
Raueiser

(10) Patent No.: US 6,685,616 B2
(45) Date of Patent: Feb. 3, 2004

(54) METHOD AND APPARATUS FOR SETTING UP AT LEAST ONE TOOL ON A TOOL CARRIER IN RELATION TO FORMAT

(75) Inventor: Reinhard Raueiser, Mueden (DE)

(73) Assignee: Winkler + Duennebier AG, Neuwied (DE)

( * ) Notice: Subject to any disclaimer, the term of this patent is extended or adjusted under 35 U.S.C. 154(b) by 0 days.

(21) Appl. No.: 09/943,867

(22) Filed: Aug. 31, 2001

(65) Prior Publication Data

US 2002/0061806 A1 May 23, 2002

(30) Foreign Application Priority Data

Sep. 1, 2000 (DE) ..... 100 43 517

(51) Int. Cl.[7] ..... B31B 1/10

(52) U.S. Cl. ..... 493/917; 493/186; 493/267; 493/454; 493/429; 493/450

(58) Field of Search ..... 493/917, 186, 493/243, 267, 454, 442, 429, 450

(56) References Cited

U.S. PATENT DOCUMENTS 4,090,433 A * 5/1978 Jardine et al. ..... 93/58.2

* cited by examiner

*Primary Examiner*—Rinaldi I. Rada
*Assistant Examiner*—Gloria R Weeks
(74) *Attorney, Agent, or Firm*—W. F. Fasse; W. G. Fasse

(57) ABSTRACT

The invention relates to a method and an apparatus for setting up at least one holding arrangement for a workpiece in relation to format and/or for setting a tool on a tool carrier, selectable positions being provided in particular for the holding arrangement, and an adjustable control element being provided as part of an adjusting and catch arrangement with positions related to the format, by means of which the holding arrangement is adjusted and fixed relative to the tool carrier.

The essence of the invention consists in the fact that at least the fixing of the adjusting and/or catch arrangement for the holding arrangement relative to the tool carrier in at least one setting position is effected magnetically.

19 Claims, 7 Drawing Sheets

METHOD AND APPARATUS FOR SETTING UP AT LEAST ONE TOOL ON A TOOL CARRIER IN RELATION TO FORMAT

FIELD OF THE INVENTION

The invention relates to a method and an apparatus for setting up at least one holding arrangement for a workpiece and/or a tool on a tool carrier in relation to a specified format. In particular, a holding arrangement serving to hold an envelope blank and a transverse creasing cylinder, as a tool carrier, may be provided.

BACKGROUND INFORMATION

It is known, for holding envelope blanks during the production of transverse creases, to apply vacuum to suction openings arranged in rows after one or two of several suction hole rows have been selected in each case in relation to the format and with respect to a creasing blade arranged rigidly at the circumference of the transverse creasing cylinder. This is done by means of expensive setting means of complicated design, so that the aim of the invention is to provide an especially simple method and an apparatus of correspondingly simple design for the accurate setting of a holding arrangement and/or of a tool on the tool carrier, i.e., in the present case, specifically on the transverse creasing cylinder.

SUMMARY OF THE INVENTION

To achieve the above stated object, the invention provides for the fixing of the adjustable holding arrangement and/or of the tool relative to the tool carrier in at least one setting position to be effected magnetically.

The magnetic fixing permits not only positioning of the holding arrangement to a highly accurate degree but also an especially easy-to-use adjusting means for the parts adjustable relative to one another. This applies in particular when the magnets belonging to the adjustable parts are in each case opposite one another with like poles.

In a development of the invention, provision is made for in each case one group of magnets to be assigned to each of the parts adjustable relative to one another and movable in each case in a guided manner. Furthermore, it may be expedient here if, in a development of the invention, one of the two groups of magnets has at least a single magnet or two magnets. If need be, it is sufficient for only a single magnet to be provided on one of the two sides.

BRIEF DESCRIPTION OF THE DRAWINGS

The invention is described in more detail below with reference to an exemplary embodiment shown in the drawing, in which.

DETAILED DESCRIPTION OF PREFERRED EMBODIMENTS OF THE INVENTION

Figure 8:
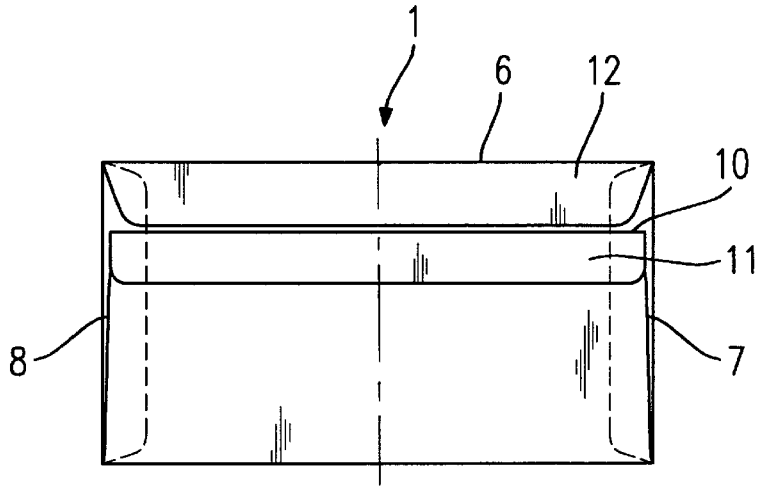
FIG. 8 shows a view of the back of an envelope with self-adhesive gumming.
Figure 9:
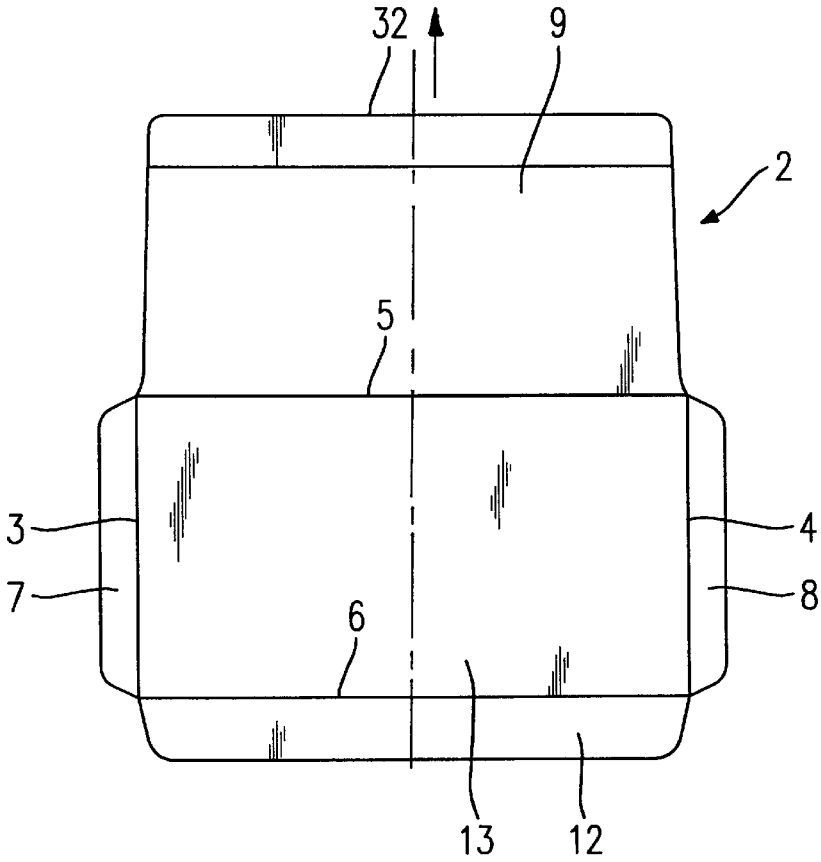
FIG. 9 shows an envelope blank for an envelope according to FIG. 8.
Figure 10:
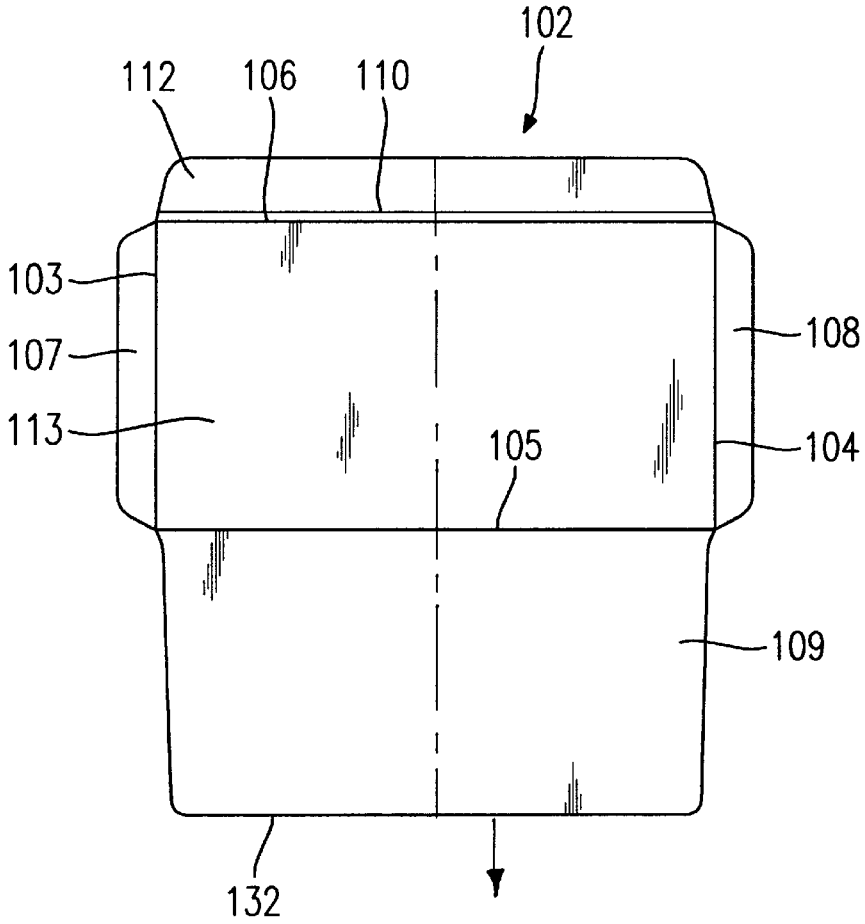
FIG. 10 shows an envelope blank with a restraightening crease.
Figure 11:
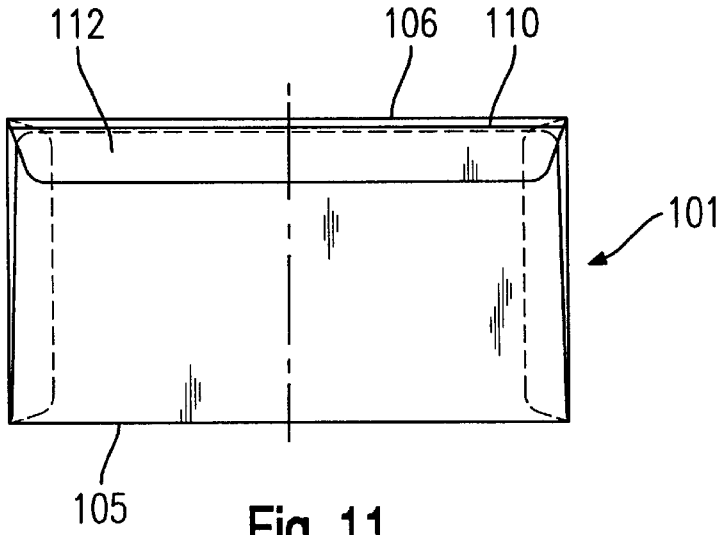
FIG. 11 shows a view of the back of an envelope according to FIG. 10.

When making envelopes 1, 101 according to FIGS. 8 and 11, respectively, it is necessary for longitudinal creases 3, 103 and 4, 104 lying in the longitudinal direction, i.e. in the transport direction (see arrow in FIG. 9 or 10), and, transversely thereto, transverse creases 5, 105 and 6, 106 to be provided in the still continuous paper web or in the already singularized envelope blanks 2, 102 according to FIGS. 9 and 10, respectively, so that an envelope 1, 101 can be produced from the envelope blanks 2, 102 by folding over and adhesively bonding the side parts 7, 107 and 8, 108 to the back part 9, 109. The envelope 1 according to FIG. 8 has an additional, third transverse crease 10 for a counter flap 11, which is turned over to begin with. The envelope 101 according to FIG. 11 likewise has a third crease for straightening the closing flap 112 again. The transverse crease 10, 110 is made on a side of the envelope blank 2, 102 which is opposite the side of the transverse creases 5, 105 and 6, 106, respectively. Except for the closing flaps, the envelopes 1, 101 largely correspond. Thus the side parts 7, 107 and 8, 108 can be folded onto one another about longitudinal creases 3, 103 and 4, 104, and the closing flap 12, 112 can be folded about the transverse crease 6, 106, and the front part 13, 113 and the back part 9, 109 can be folded onto one another about the transverse crease 5, 105.

Figure 1:
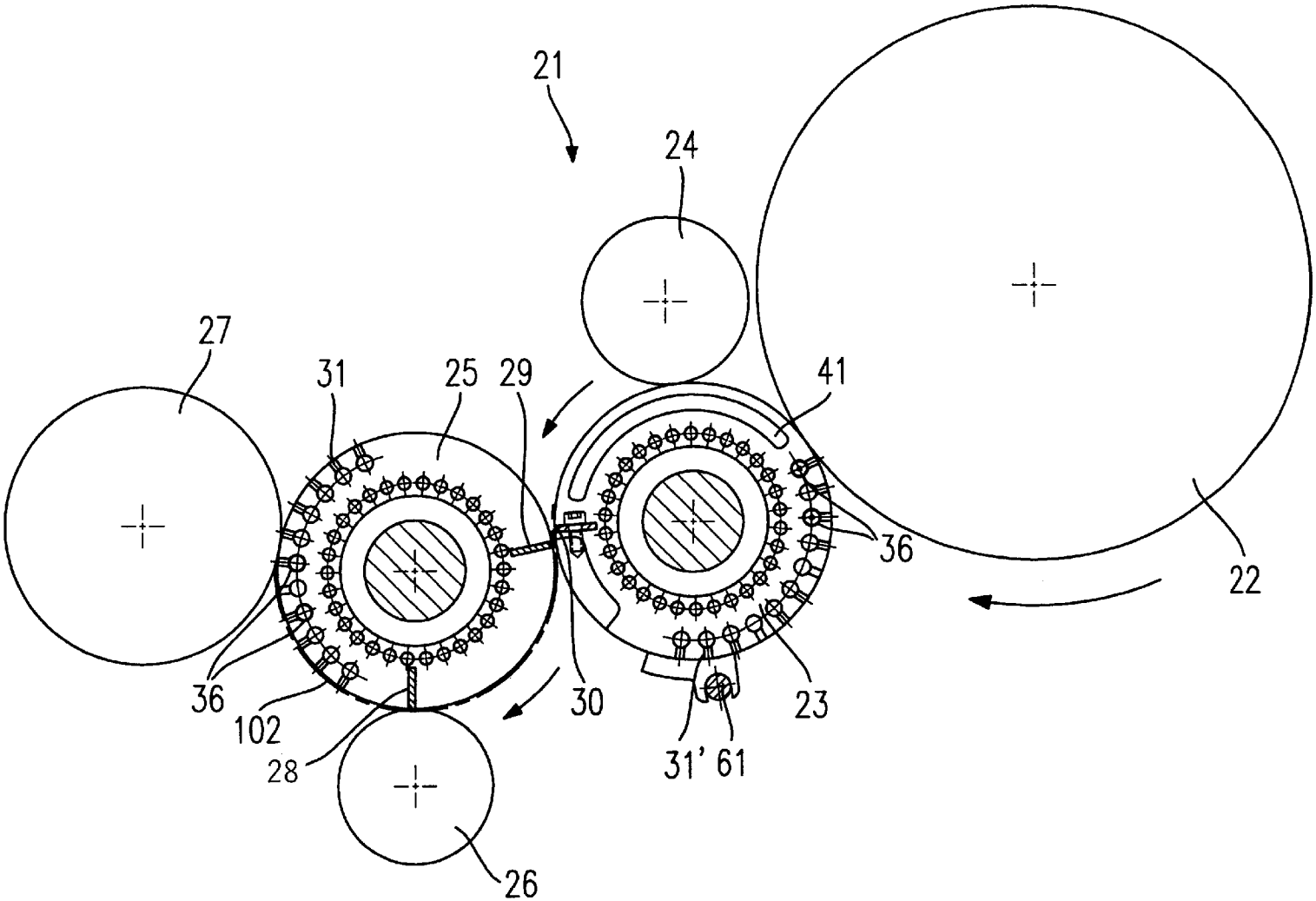
FIG. 1 shows a schematic side view of the essential parts of a creasing station in an envelope making machine.

To produce the transverse creases 5, 105 or 6, 106 and 10, 110, a transverse creasing station 21 is provided in an envelope making machine and comprises a plurality of cylinders and rollers, which in the exemplary embodiment shown schematically in FIG. 1 are a feed cylinder 22 and, in the transport direction, a first transverse creasing cylinder 23 with a counter-cylinder 24, and a second transverse creasing cylinder 25 with an associated counter-cylinder 26, and also a transport cylinder 27, likewise only shown schematically. The envelope blank 102 is shown by a dot-dash line in FIG. 1 on parts of the circumference of the two transverse creasing cylinders 23 and 25.

The transverse creasing cylinders 23 and 25 have creasing blades 28, 29. It is basically the case here that one creasing blade, such as, for example, the creasing blade 28 on the associated transverse creasing cylinder 25, is arranged rigidly, whereas the other creasing blade 29 is adjustable in the circumferential direction. This is not shown in detail in FIG. 1.

The position of the envelope blank, shown schematically by dot-dash line in FIG. 1, with regard to the position of the creasing blades 28, 29 and 30 likewise does not correspond to the actual working position. The two transverse creasing cylinders 23 and 25, with the creasing blade(s) 28 in each case arranged rigidly, and their holding arrangements 31 and 31' still have to be set and fixed compared with the representation in FIG. 1.

As a rule, the envelope blank 2, 102 is drawn through the transverse creasing station 21 by the various cylinders and rollers located there. To this end, the holding arrangement 31'0 on the first transverse creasing cylinder 23 receives the envelope blank 2 or 102 from the feed cylinder 22 and delivers it during the passage to the second transverse creasing cylinder 25, for which purpose its holding arrangement 31' likewise receives the leading end 32 or 132 of the envelope blank in a synchronized manner. The two holding arrangements 31 and 31 consist of a suction arrangement which is known in principle, works with vacuum and comprises suction hole rows 33, 33*a*, 33*b*, etc., with suction openings 35 arranged at the circumference 34 of each transverse creasing cylinder 23, 25. The suction openings 35 of each suction hole row 33 are connected to one another by bores 36. The bores 36 each end at an end face 37 of each transverse creasing cylinder 23 or 25, respectively.

A control valve 38 adjoins the creasing cylinder 23 or 25, respectively, at the end face and is connected to a vacuum line 39. A coaxially directed suction air passage 40 and a suction air section 41 extending in the circumferential direction are located in the control valve 38. The use of such holding arrangements 31 with suction hole rows at the circumference 34 of the transverse creasing cylinders and with control valves 38 which have suction air passages 40 and suction air sections 41 is basically prior art and for this reason needs no further explanation. The control valve 38 does not rotate with the respective transverse creasing cylinder 23 or 25, which is mounted via a shaft 42 in a machine frame 43 and is set in rotation via a drive element 44.

In addition, there is also a control element 46 on that end 45 of the transverse creasing cylinder 23, 25 which has the end face 37, this control element 46 being adjustable relative to the approximately cylindrical cylinder body 47 of the transverse creasing cylinder 23, 25. It is guided or arranged so as to be pivotable on the cylinder body 47. It serves to open or close the bores 36 which lead to the suction openings 35 at the circumference of the transverse creasing cylinder 23, 25.

Figure 3:
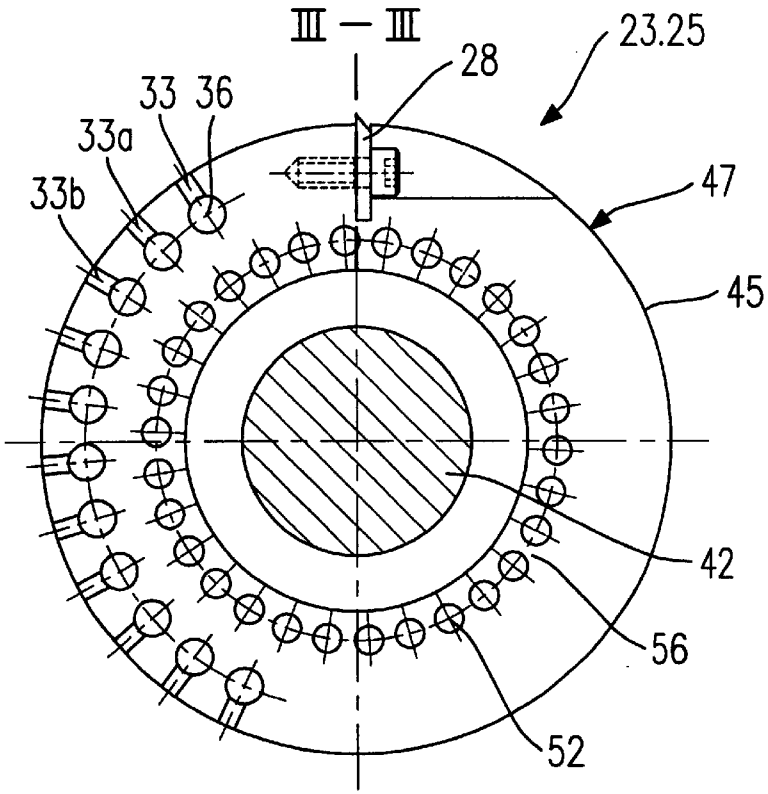
FIG. 3 shows, again on another scale, a section along line III—III in FIG. 2.
Figure 5:
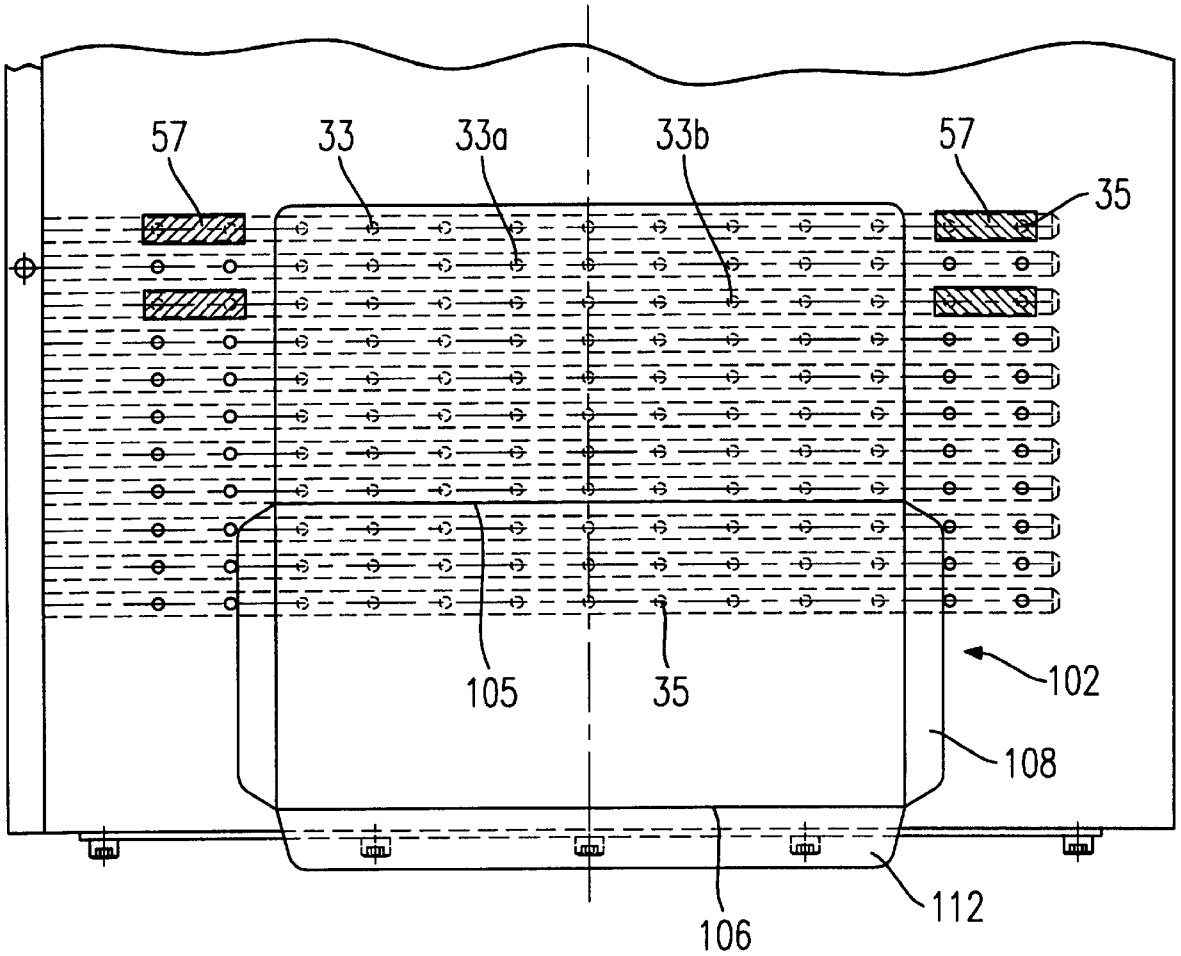
FIG. 5 shows a schematic representation of essential parts of the transverse creasing cylinder with an envelope blank.

As can be seen from FIGS. 1, 3 and 5, each transverse creasing cylinder 23, 25 has a multiplicity of suction hole rows 33, 33*a*, 33*b*, etc., arranged parallel to one another and on the same radius. A bore 36 belongs to each suction hole row 33, etc. By means of the control element 46, the effect is achieved that in each case only one bore 36 or two directly or indirectly adjacent bores 36 are connected to the vacuum in the vacuum line 39 via the control valve 38. By means of the control element 46, arranged in an adjustable manner at the front end of the creasing cylinder 23, 25, the bore 36 belonging to the one or the other suction hole row 33, 33*a*, etc., is therefore connected as required to the vacuum in the vacuum line 39 via the control valve 38. To this end, the control element 46 has at least one bore 48, 49, these bores 48, 49 lying on the same radius as the bores 36 or as the suction air section 41 extending in the circumferential direction in the control valve 38. On account of the bores 48 and 49, respectively, the same vacuum prevails in the bores 36 of the connected suction hole rows as along the suction air section 41 or as in the vacuum line 39.

The suction air section 41 extends only over a limited curved segment up to an intermediate wall. A chamber 50 in which atmospheric pressure prevails is then provided. As soon as the control element 46 passes into the region of the chamber 50, the vacuum in the bore/bores 36 and thus at the suction hole rows 33 acted upon collapses, with the result that the holding arrangement 31, 31' loses its effect.

The control element 46, mounted on the cylinder body 47 in a rotatable or pivotable manner, serves on the one hand to select the one or the other suction hole row and on the other hand to at the same time also fix the selected position. This is done by means of magnets 51 on the control element 46 and by means of magnets 52 on the front end 45 of the cylinder body 47.

Figure 4:
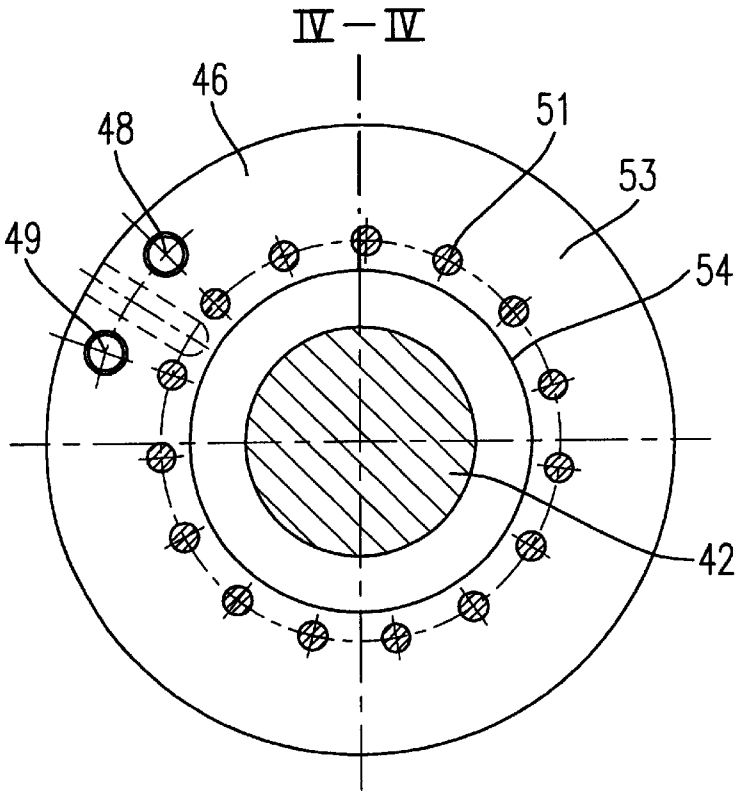
FIG. 4 shows a section as in FIG. 3 along line IV—IV in FIG. 2.

According to the exemplary embodiment shown in FIGS. 3 and 4, the magnets 51 are arranged on the control element 46 in an annular manner. The same applies in principle to the magnets 52 on the front end 45 of the cylinder body 47.

Figure 2:
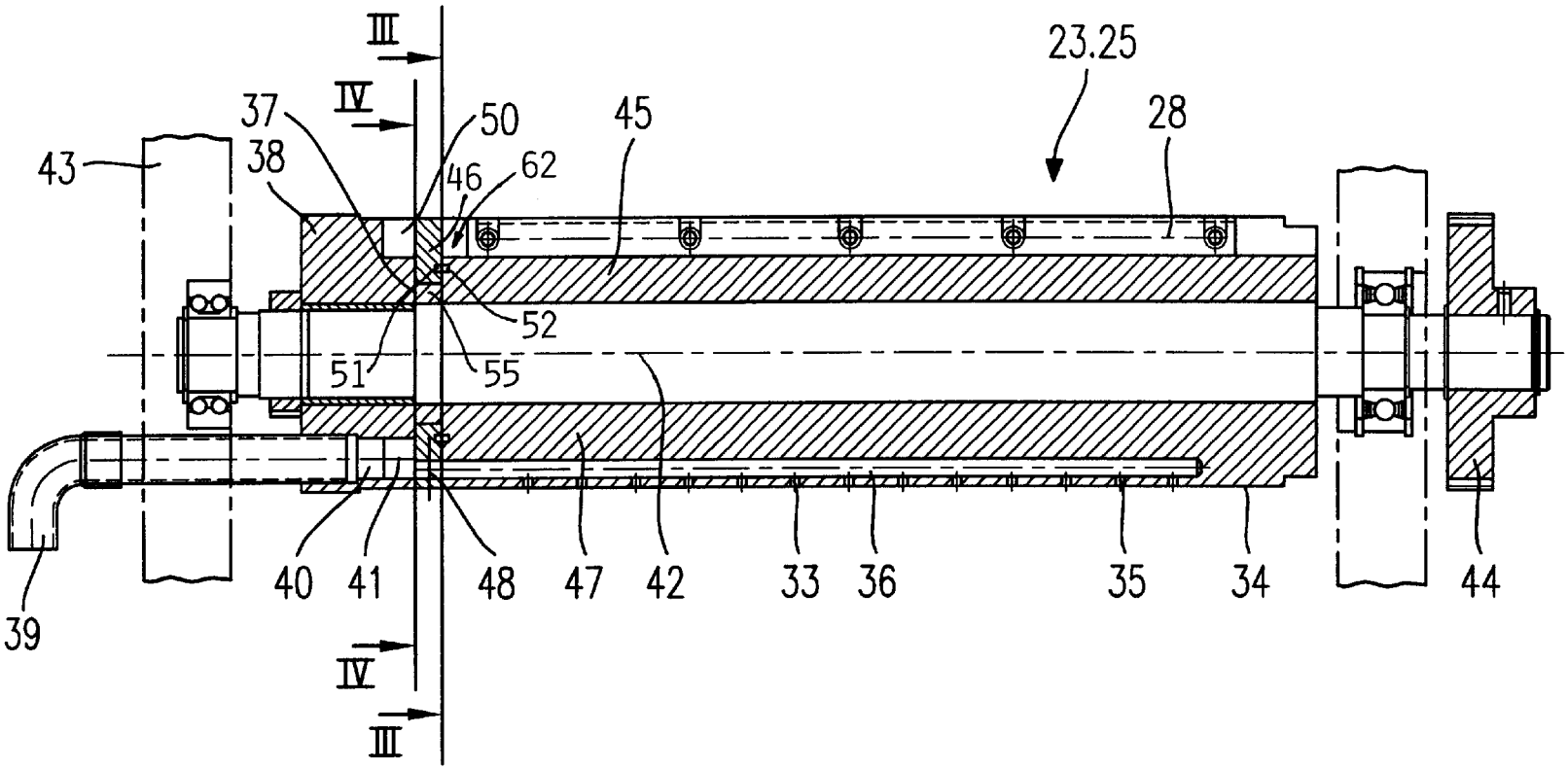
FIG. 2 shows, on a different scale, a section through a creasing cylinder and its mounting and the suction air connection.

The magnets 51 are located in alignment in an annular end face 53 of the control element 46, which according to the exemplary embodiment is mounted in a rotatable manner with a bore 54 (FIG. 4) on an annular end piece 55 of the cylinder body 47 (FIG. 2). The magnets 52 are likewise located in an annular end face 56 on the free end 45 of the cylinder body 47 in such a way that they lie on the same radius as the magnets 51 of the control element 46.

Figure 7:
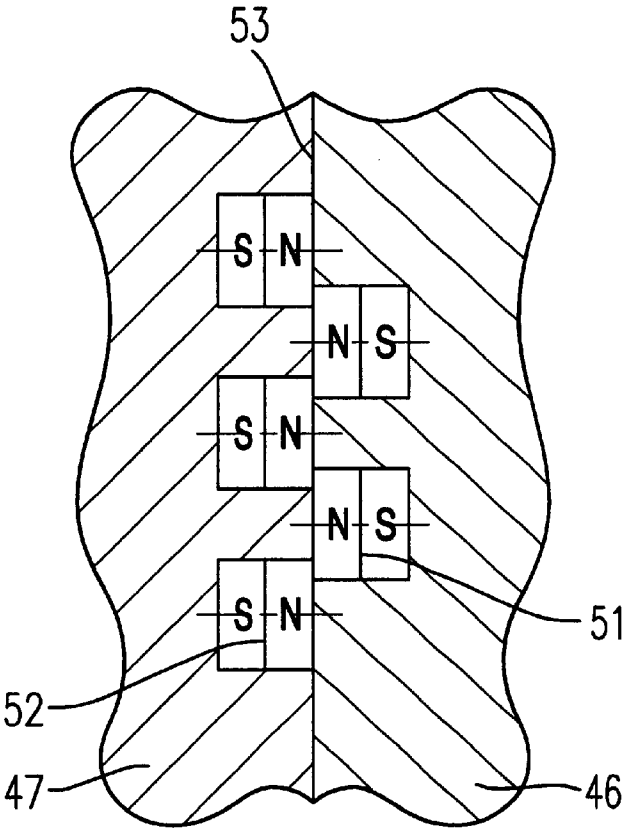
FIG. 7 shows a representation as in FIG. 6 with magnets having like poles opposite one another and offset relative to one another.
Figure 6:
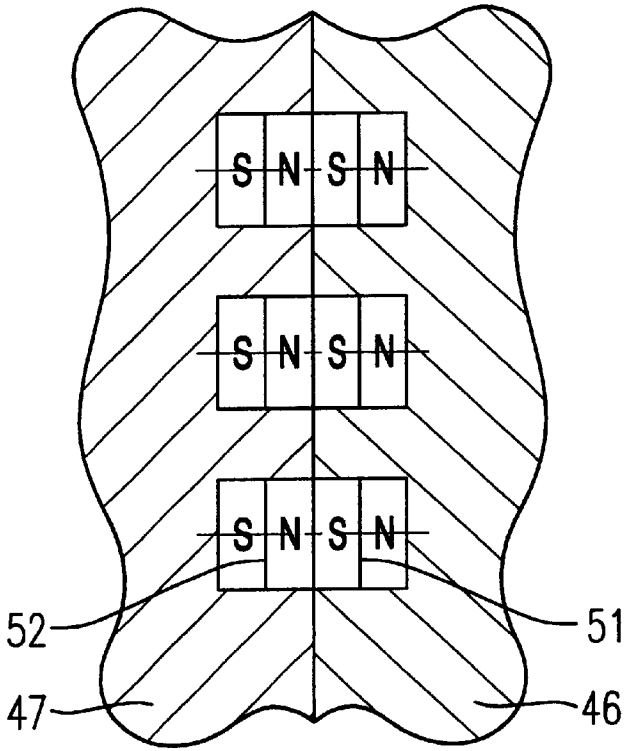
FIG. 6 shows, again on a larger scale, a truncated section through the creasing cylinder and through the control element with magnets having unlike poles opposite one another.

The number and position of the magnets 51 and 52, respectively, is selected in such a way that the desired setting positions can be achieved. To this end, the magnets 51 and 52 may either be opposite one another directly in the setting positions with opposite poles according to FIG. 6, or they may also be opposite one another with like poles, i.e. the same poles, and be offset or staggered relative to one another, as shown in FIG. 7.

If the magnets 51 and 52 are opposite one another with opposite poles (FIG. 6), the magnets attract one another and also the parts 46 and 47, respectively, carrying them. An adjustment of the parts 46 and 47 relative to one another therefore involves a certain expenditure of force. However, if the magnets 51 and 52 are opposite one another with like, i.e. the same, poles according to FIG. 7 and in their respective end faces 53 and 56, respectively, they repel one another, with the result that the control element 46 can be adjusted relatively easily with respect to the cylinder body 47, in particular if the magnets 51 and 52 are additionally offset relative to one another in the respective setting and catch positions (FIG. 7). The control element 46 then jumps from setting position to setting position and is reliably fixed in each of these positions.

According to the representation in FIG. 5, vacuum is applied to the suction hole rows 33 and 33*b*. Suction openings 35 located outside the envelope blank 2 are in each case covered with an adhesive strip 57, so that infiltrated air is not drawn in.

Finally, FIG. 1 shows a holding arrangement 61 for the control valve 38, so that it cannot change its position in the machine frame 43.

Furthermore, FIG. 1 shows the position of the suction air section 41, which starts at the transfer point of the feed cylinder 22 and ends just in front of the delivery point to the second creasing cylinder 25.

According to the exemplary embodiment, the control element 46 is annular and, together with the magnets 51 arranged in alignment on it and with the magnets 52 arranged on the same radius at the end face in the cylinder body 47, forms an adjusting and catch arrangement 62. The magnets 51 and 52 are expediently permanent magnets.

The magnets 51 and 52 in each case form a group in the control element 46 and respectively at the end face in the cylinder body 47 of the transverse creasing cylinder 23 or 25, respectively. One of the two groups may also consist of only two magnets or if need be also of a single magnet.

Finally, the invention is not restricted to use in a creasing station of an envelope making machine. It may also be used in another connection if it is a matter of setting a holding arrangement for a workpiece and/or a tool relative to a tool carrier in selectable positions and of fixing it in the respectively selected position.

What is claimed is:

1. An envelope making machine comprising:

a holding arrangement adapted to hold an envelope blank having a specified format;

a tool carrier adapted to carry a tool for processing the envelope blank; and an adjusting and fixing arrangement including an adjustable control element by which a position of said holding arrangement relative to said tool carrier is adjusted and fixed at a selected position related to the specified format among plural available positions, wherein said adjusting and fixing arrangement further includes magnets which magnetically fix said holding arrangement relative to said tool carrier at said selected position.

2. The envelope making machine according to claim 1, wherein said magnets are permanent magnets.

3. The envelope making machine according to claim 1, wherein said control element has a first end face, wherein said tool carrier comprises a cylinder body having a second end face that faces said first end face, and wherein said magnets include first and second magnets arranged respectively annularly on said first end face of said control element and on said second end face of said cylinder body.

4. The envelope making machine according to claim 3, wherein said first and second end faces are respective annular end faces, and wherein said envelope making machine comprises a transverse creasing cylinder that is adapted to transversely crease the envelope blank and that comprises said cylinder body of said tool carrier.

5. The envelope making machine according to claim 3, wherein said first and second magnets include at least one said first magnet arranged on said first end face and at least one said second magnet arranged on said second end face.

6. The envelope making machine according to claim 3, wherein said first and second magnets include a plurality of said first magnets arranged on said first end face and a plurality of said second magnets arranged on said second end face, and wherein at least a respective one of said first magnets is respectively arranged at each respective one of plural first circumferential locations on said first end face and at least a respective one of said second magnets is respectively arranged at each respective one of plural second circumferential locations on said second end face thereby defining said plural available positions.

7. A method of using the envelope making machine according to claim 1, comprising the following steps:

dependent on the specified format of the envelope blank, selecting one of said plural available positions as said selected position related to the specified format;

adjusting said adjustable control element to said selected position; and fixing said adjustable control element at said selected position by a magnetic force generated by said magnets, whereby said holding arrangement is magnetically fixed relative to said tool carrier at said selected position.

8. An apparatus for creasing a workpiece, said apparatus comprising:

a transverse creasing cylinder that includes a cylinder body serving as a tool carrier, at least one creasing blade carried by said cylinder body, and plural suction hole rows of suction holes penetrating through a circumferential surface of said cylinder body and serving as a holding arrangement adapted to suction-hold the workpiece;

an adjustable control element that is adjustable to any selected position among plural available positions relative to said cylinder body so as to correspondingly activate at least a selected one of said suction hole rows to apply suction to the workpiece, dependent on a specified format of the workpiece; and magnets arranged on said control element and said cylinder body and adapted to magnetically fix said control element in said selected one of said positions relative to said cylinder body.

9. The apparatus according to claim 8, wherein said magnets are permanent magnets.

10. The apparatus according to claim 8, wherein said magnets include first magnets arranged annularly on a first annular end face of said control element, and second magnets arranged annularly on a second annular end face of said cylinder body facing toward said first end face of said control element and aligned on an annular arc with said first magnets.

11. The apparatus according to claim 8, wherein said magnets and said suction hole rows are respectively arranged at different radii about a common axis of said cylinder body and said control element.

12. A method of using the apparatus according to claim 8, comprising the following steps:

dependent on the specified format of the workpiece, selecting one of said plural available positions as said selected position related to the specified format;

adjusting said adjustable control element to said selected position; and fixing said adjustable control element at said selected position by a magnetic force generated by said magnets, whereby said holding arrangement is magnetically fixed relative to said tool carrier at said selected position.

13. An apparatus for processing a workpiece, said apparatus comprising:

a holding arrangement adapted to hold a workpiece having a specified format;

a tool carrier adapted to carry a tool for processing the workpiece; and an adjusting and fixing arrangement including an adjustable control element by which a position of said holding arrangement relative to said tool carrier is adjusted and fixed at a selected position related to the specified format among plural available positions;

wherein said adjusting and fixing arrangement further includes magnets which magnetically fix said holding arrangement relative to said tool carrier at said selected position; and wherein said magnets include first magnets that are arranged on said control element and second magnets that are arranged on said tool carrier and are offset in a circumferential direction relative to said first magnets when said holding arrangement is fixed at said selected position relative to said tool carrier.

14. The apparatus according to claim 13, wherein said first magnets and said second magnets respectively have like magnetic poles facing one another.

15. An apparatus for processing a workpiece, said apparatus comprising:

a holding arrangement adapted to hold a workpiece having a specified format;

a tool carrier adapted to carry a tool for processing the workpiece; and an adjusting and fixing arrangement including an adjustable control element by which a position of said holding arrangement relative to said tool carrier is adjusted and fixed at a selected position related to the specified format among plural available positions;

wherein said adjusting and fixing arrangement further includes magnets which magnetically fix said holding arrangement relative to said tool carrier at said selected position;

wherein said magnets include first magnets arranged on said control element and second magnets arranged on said tool carrier; and wherein said first and second magnets are arranged respectively opposite one another with like magnetic poles or with opposite magnetic poles facing one another.

16. The apparatus according to claim 15, wherein said first and second magnets are arranged respectively opposite one another with like magnetic poles facing one another.

17. The apparatus according to claim 15, wherein said first and second magnets are arranged respectively opposite one another with opposite magnetic poles facing one another.

18. The apparatus according to claim 15, wherein said control element has a first end face, said tool carrier comprises a cylinder body having a second end face, said first magnets are arranged annularly on said first end face, and said second magnets are arranged annularly on said second end face.

19. The apparatus according to claim 15, wherein said magnets are permanent magnets.

* * * * *